US008277610B2

(12) United States Patent
Katz

(10) Patent No.: US 8,277,610 B2
(45) Date of Patent: Oct. 2, 2012

(54) MECHANICAL FIBER PAPER WITH CONTROLLED CURL

(75) Inventor: Bruce Irwin Katz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 182 days.

(21) Appl. No.: 11/733,537

(22) Filed: Apr. 10, 2007

(65) Prior Publication Data

US 2008/0251226 A1 Oct. 16, 2008

(51) Int. Cl.

| | |
|---|---|
| ***D21H 11/08*** | (2006.01) |
| ***D21H 11/14*** | (2006.01) |
| ***D21H 27/30*** | (2006.01) |
| ***B32B 29/00*** | (2006.01) |

(52) U.S. Cl. ..... 162/123; 162/135; 162/142; 162/147; 162/149; 162/150; 428/172; 428/195.1; 428/340

(58) Field of Classification Search ..... 162/123–137, 162/141–142, 147, 149–150, 158, 197, 204; 428/334, 340, 195.1, 172

See application file for complete search history.

(56) References Cited

U.S. PATENT DOCUMENTS

| | | | | |
|---|---|---|---|---|
| 4,431,479 | A * | 2/1984 | Barbe et al. | 162/9 |
| 5,212,040 | A * | 5/1993 | Sanders et al. | 430/125.3 |
| 5,394,247 | A * | 2/1995 | Vahey et al. | 356/429 |
| 5,416,980 | A | 5/1995 | Ilvespaeae | |
| 5,557,860 | A | 9/1996 | Kotitschke et al. | |
| 5,580,373 | A | 12/1996 | Lane et al. | |
| 6,120,954 | A * | 9/2000 | Matsuda et al. | 430/47.5 |
| 6,221,210 | B1 * | 4/2001 | Kurihara et al. | 162/100 |
| 6,923,889 | B2 * | 8/2005 | Huuskonen et al. | 162/135 |
| 2002/0051865 | A1 * | 5/2002 | Hasegawa et al. | 428/141 |
| 2003/0051840 | A1 * | 3/2003 | Ochi et al. | 162/158 |
| 2004/0065423 | A1 * | 4/2004 | Swerin et al. | 162/137 |
| 2004/0154765 | A1 * | 8/2004 | Huuskonen et al. | 162/135 |
| 2004/0244928 | A1 * | 12/2004 | Huang et al. | 162/135 |
| 2005/0011624 | A1 * | 1/2005 | Korhonen et al. | 162/205 |
| 2006/0159871 | A1 * | 7/2006 | Agrawal et al. | 428/32.1 |
| 2008/0035292 | A1 * | 2/2008 | Singh et al. | 162/175 |
| 2008/0251226 | A1 * | 10/2008 | Katz | 162/201 |

FOREIGN PATENT DOCUMENTS

| | | | |
|---|---|---|---|
| EP | 1980666 | A1 * | 10/2008 |
| JP | 07209897 | A * | 8/1995 |
| JP | 10204793 | A | 8/1998 |
| JP | 10292299 | A * | 11/1998 |
| JP | 11028897 | A | 2/1999 |
| WO | 98/44191 | A | 10/1998 |
| WO | 02/103109 | A | 12/2002 |

OTHER PUBLICATIONS

JPO Machine Translation of JP 07-209897, Published on Aug. 11, 1995.*

JPO Machine Translation of JP 10-292299, Published on Nov. 4, 1998.*

Handbook of Physical Testing of Paper; R. E. Mark, C. C. Habeger, Jr., J. Borch, M. B. Lyne; Marcel Dekker, Inc.; 2002, vol. 1, Second Edition, Revised and Expanded, pp. 156-157 and 171.

* cited by examiner

*Primary Examiner* — Jose A Fortuna

(74) *Attorney, Agent, or Firm* — MH2 Technology Law Group LLP

(57) ABSTRACT

A xerographic paper and method of forming includes mechanical fiber and a predetermined curl control defined by a split sheet contraction measurement. The split sheet contraction can be between about 0.8 and about 1.2 and between about 0.9 and about 1.1. Split sheet contraction is defined by a relationship of paper shrinkage in a cross-direction to paper shrinkage in a machine-direction and between the two sides of the sheet when split in the Z-direction.

12 Claims, No Drawings

MECHANICAL FIBER PAPER WITH CONTROLLED CURL

FIELD OF THE INVENTION

The present invention generally relates to paper production, and more particularly, to xerographic type paper including a mechanical fiber with a predetermined and controlled amount of curl.

BACKGROUND OF THE INVENTION

In the production of xerographic paper, it is known to formulate paper with either of a chemical pulp or mechanical pulp. In general, chemical pulp is formed starting with wood chips which are subjected to chemical, heat, and pressure to separate the cellulose fibers from the wood to prepare the pulp. Since cellulose represents less than half of the weight of the wood, the yield is typically about 45% of the wood weight available to the paper manufacturer. Mechanical pulp can be prepared by the mechanical grinding of wood, resulting in about 90% of the wood weight converted to papermaking fiber. The grinding is done with refiners powered in part by hydroelectricity, and the heat of the steam produced during the grinding is utilized in the papermaking operation to dry the paper. Thus, production of chemical pulp requires approximately twice the number of trees compared to production of a like quantity of mechanical pulp. Accordingly, there is high demand for environmentally friendly paper predominantly or exclusively incorporating mechanical fibers.

However, as part of the xerographic process, paper passes through a fusing system, in which heat and/or pressure is applied to the paper in order to fix a toner to the sheet. The presence of heat can cause a moisture loss within fibers of the paper to the extent that the paper can contract. Uneven contraction of the paper fibers across the thickness (Z-direction) of the sheet can result in an undesirable curling of the paper Problems can occur with excessive curling of the paper. For example, curling of the paper can affect performance of the paper in both a xerographic unit and subsequent paper handling devices. Thus, the curl should be maintained within predetermined acceptable limits.

In known papermaking processes, the curl can be maintained at predetermined limits by making adjustments to the papermaking machine. However, these adjustments can be time consuming, requiring substantial down time for printing units as components are adjusted. Adjustment can be required at any of the wet end, wires, ringers, dyers, calenders, and dry end of the equipment for even a single run. However, adjustment for curl of the formed paper per se, still does not satisfactorily address the end use of the manufactured paper as xerographic paper, which is subject to press heat. Manufacturers may use several methods to predict curl performance in xerographic systems, however, no consistent and satisfactory limits of curl have been established and repeatable achieved prior to the following disclosure.

Thus, there is a need to overcome these and other problems of the prior art and to provide a method and product including mechanical fiber to yield a xerographic paper having a predetermined curl properties.

SUMMARY OF THE INVENTION

In accordance with the present teachings, a xerographic paper is provided.

The exemplary xerographic paper can include mechanical fiber and a predetermined curl property defined by a predetermined split sheet contraction.

In accordance with the present teachings, a method of forming paper is provided.

The exemplary method can include providing a paper formed from a pulp containing mechanical fiber and providing a curl property within a predetermined limit defined by split sheet contraction measurements.

It is to be understood that both the foregoing general description and the following detailed description are exemplary and explanatory only and are not restrictive of the invention, as claimed.

The following description refers to several embodiments of the invention and serves to explain the principles of the invention.

DESCRIPTION OF THE EMBODIMENTS

Reference will now be made in detail to the exemplary embodiments of the invention. However, one of ordinary skill in the art would readily recognize that the same principles are equally applicable to, and can be implemented in devices other than xerographic paper, and that any such variations do not depart from the true spirit and scope of the present invention. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

For descriptive purposes, known paper making machines, such as, for example a Fourdrinier machine, can be used to form paper having characteristics described in the following. Since the described invention can be applicable to a variety of papermaking devices, the following general description will be without reference to drawing figures, thereby establishing an understanding of the environment of the invention without limitation to any particular papermaking device. Accordingly, and in general, a papermaking machine may be divided into four sections: the wet end, the press section, the drier section, and the calender section. In the wet end, the pulp or stock flows from a headbox through a slice onto a moving endless belt of wire cloth, called the fourdrinier wire or wire, of brass, bronze, stainless steel, or plastic. The wire runs over a breast roll under or adjacent to the headbox, over a series of tube or table rolls or more recently drainage blades, which maintain the working surface of the wire in a plane and aid water removal. The tubes or rolls create a vacuum on the downstream side of the nip. Similarly, the drainage blades create a vacuum on the downstream side where the wire leaves the blade surface, but also performs the function of a doctor blade on the upstream side. The wire then passes over a series of suction boxes, over the bottom couch roll (or suction couch roll), which drives the wire and then down and back over various guide rolls and a stretch roll to the breast roll. The second section, the press section, usually consists of two or more presses, the function of which is to mechanically remove further excess of water from the sheet and to equalize the surface characteristics of the felt and wire sides of the sheet. The wet web of paper, which is transferred from the wire to the felt at the couch roll, is carried through the presses on the felts; the texture and character of the felts vary according to the grade of paper being made. The third section, the drier section, consists of two or more tiers of driers. These driers are steam-heated cylinders, and the paper is held close to the driers by means of fabric drier felts. As the paper passes from one drier to the next, first the felt side and then the wire side comes in contact with the heated surface of the drier. As the paper enters the drier train approximately one-third dry, the bulk of the water is evaporated in this section. Moisture removal may be facilitated by blowing hot air onto the sheet and in between the driers in order to carry away the water vapor. Within the drier section and at a point at least 50% along the drying curve, a breaker stack is sometimes used for imparting finish and to facilitate drying. This equipment is usually comprised of a pair of chilled iron and/or rubber surfaced rolls. There may also be a size press located within the drier section, or more properly, at a point where the paper moisture content is approximately 5 percent. The fourth section of the machine, the calender section, consists of from one to three calender stacks with a reel device for winding the paper into a roll as it leaves the paper machine. The purpose of the calender stacks is to finish the paper, i.e., the paper is smoothed and the desired finish, thickness or gloss is imparted to the sheet. The reel winds the finished paper into a roll, which for further finishing either can be taken to a rewinder or, as in the case of some machines, the rewinder on the machine produces finished rolls directly from the machine reel. The wire, the press section, the several drier sections, the calender stacks, and the reel are so driven that proper tension is maintained in the web of paper despite its elongation or shrinkage during its passage through the machine.

Embodiments pertain generally to xerographic paper, and more particularly, to xerographic paper formed from mechanical fibers and having a curl property within predetermined limits therein. Although the embodiments are described in connection with xerographic paper it will be appreciated that the embodiments can be applicable to other types of paper exhibiting curl upon heating and/or application of toner. For example, the embodiments are equally applicable to offset preprint paper.

One desired characteristic of xerographic paper includes an ability to maintain curl within acceptable limits for performance in paper handling devices. Even though adjustments can be made in a papermaking machine to minimize curl during production, the same level of control is not found when paper is passed through a copier, printer, or the like. Predicting and controlling curl, can therefore, be problematic.

Accordingly, one method for determining an amount of curl that will result after the printing or copying is referred to as a "Split Sheet Contraction" measurement as developed by Xerox Corporation. It has been appreciated by the inventor that individual fibers will shrink more in width thereof than in length. Further, a sheet is typically on the order of about 6 to about 10 fibers thick. Thus, split sheet contraction is based on the premise that paper will shrink more in a cross-direction (CD) than in a machine direction (MD) and curl can be minimized by balancing the shrinkage between the two "layers" of the sheet. By splitting the sheet in a Z-direction and using known relationships between expected CD shrinkage and MD shrinkage for samples taken from each of two sides, a relationship between the two sides can be compared to expected levels. A flat sheet will result when targets of the relationship between the two sides have reached unity.

By achieving targets of the relationship between the two sides to about unity, a relatively flat sheet can result, even upon application of heat and/or toner during subsequent processing. In order to achieve the relatively flat sheet, the paper can include mechanical fiber with a split sheet contraction of between about 0.8 and about 1.2. Further, the paper can include mechanical fiber with split sheet contraction of between about 0.9 and about 1.1.

Control of the split sheet contraction ranges can be done with paper machine wet-end set-up changes. Although proper paper machine operation includes many characteristics and curl can be impacted at both the wet end and dry end of the paper machine, the present invention can obtain the desired curl control with wet end set up alone by controlling stresses between fibers of the mechanical pulp. More specifically, wet-end set up changes can be adjusted in relation to jet-to-wire ratios or impingement ("L/b"). The Jet-to-wire ratio (sometimes "j/w") is the ratio of the jet speed (rate of the speed of the papermaking slurry is extruded to the moving paper machine wire. A jet-to-wire speed of greater than 1 means that the sheet is being formed by "rushing"; a jet-to-wire speed of less than 1 means that the sheet is being formed by "dragging". The angle of impingement of the jet onto the wire is governed by the paper machine headbox pressure and the relationship between the width of the orifice ("slice") and extension position of the lower "lip" of the headbox.

The adjustments at the wet end are particularly controlled to obtain paper having a split sheet contraction of between about 0.8 and about 1.2. Further, the wet end adjustments are controlled to obtain paper having a split sheet contraction of between about 0.9 and about 1.1.

With the use of mechanical fibers, the resulting paper can have a higher opacity than typical with paper formed with chemical pulp. For example, samples of about 67 grams per square meter (gsm) mechanical fiber paper have the same opacity of a "typical" 90 grams per square meter paper (at 92% opacity). This can result in a benefit of reduced mailing and shipping costs, as well as potentially lower sheet costs per page.

A quantity of mechanical fibers in the pulp can be up to 100%. However, it is expected that 100% mechanical fiber can be routinely used in order to obtain benefits of using mechanical fiber pulp. Even further, the range of mechanical pulp can be from at least 40% to 100%. The mechanical fiber can be from softwood trees, for example, coniferous trees. In the exemplary embodiments, the mechanical pulp can be entirely coniferous, however, the mechanical pulp can include a percentage of hardwood (deciduous) or non-wood fibers according to paper requirements. Additionally, the mechanical fiber can be from recycled materials.

By way of non-limiting examples, 100% thermomechanical pulp can be used as the mechanical fibers. Other examples include, but are not limited to stone groundwood, pressurized stone groundwood, bleached chemical thermomechanical pulp, and unbleached chemical thermomechanical pulp. By way of comparison, typical copy paper contains about one-third of its content in softwood and two-thirds of its content in hardwood. The softwood is used for strength and contains the longer fibers which are more susceptible to curl, whereas the hardwood is used for its shorter fibers and to compensate for the curl of the softwood.

Thus, the exemplary embodiments can include mechanical fibers and have a predetermined expected curl limit to achieve suitability for xerographic systems. The paper product can further include surface treatments. The surface treatments can include, for example, traditional surface sizing or surface coating. Even further, the surface treatment provides improved toner adhesion and low dust characteristics.

Although the relationships of components are described in general terms, it will be appreciated by one of skill in the art can add, remove, or modify certain components without departing from the scope of the exemplary embodiments.

It will be appreciated by those of skill in the art that several benefits are achieved by the exemplary embodiments described herein and include a lightweight paper with high bulk for maintaining opacity and stiffness. Further, the paper will have a lower cost per page, lower mailing cost, and optimal duplex printing performance due to the high opacity.

While the invention has been illustrated with respect to one or more exemplary embodiments, alterations and/or modifications can be made to the illustrated examples without departing from the spirit and scope of the appended claims. In particular, although the method has been described by examples, the steps of the method may be performed in a difference order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any an all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A paper comprising:

mechanical fibers comprising about 100 percent of the paper;

a first layer proximal a top side of the paper, the first layer including one or more of the mechanical fibers in a cross-direction, wherein the first layer defines a first relationship between a cross-direction shrinkage of the first layer and a machine-direction shrinkage of the first layer; and a second layer proximal a bottom side of the paper, the second layer including one or more of the mechanical fibers in the cross-direction, wherein the second layer defines a second relationship between a cross-direction shrinkage of the second layer and a machine-direction shrinkage of the second layer, wherein the first and second relationships are substantially equal such that a split sheet contraction parameter defined by a ratio of the first and second relationships is between 0.8 and 1.2.

2. The paper of claim 1, wherein the split sheet contraction parameter is between 0.9 and 1.1.

3. The paper of claim 1, wherein the mechanical fiber comprises 100% mechanical fiber.

4. The paper of claim 1, wherein the mechanical fiber comprises bleached or unbleached chemical thermomechanical pulp.

5. The paper of claim 1, wherein the mechanical fiber comprises thermomechanical pulp.

6. The paper of claim 1, further comprising a surface treatment, the surface treatment comprising one or more of a surface coating and surface sizing.

7. The paper of claim. 1, wherein the mechanical fiber comprises less than 90 grams per square meter of mechanical fiber paper, including at least any coat weight and fillers.

8. The paper of claim 7, wherein the paper itself comprises opacity in the range of from about 92% to about 100%.

9. The paper of claim 1, wherein the mechanical fiber comprises a mixture of soft and hardwoods.

10. The paper of claim 1, wherein at least a portion of the mechanical fiber comprises recycled materials.

11. The paper of claim 1, wherein the first layer is on the top side of the paper and the second layer is on the bottom side of the paper the top and bottom sides being parallel and opposing.

12. The paper of claim 1, wherein the paper is configured for xerographic use.

* * * * *